US007637481B2

(12) United States Patent
Forero

(10) Patent No.: US 7,637,481 B2
(45) Date of Patent: Dec. 29, 2009

(54) ADJUSTABLE FENCE CLIP

(76) Inventor: Gustavo Forero, P.O. Box 33084, Indialantic, FL (US) 32903

( * ) Notice: Subject to any disclaimer, the term of this patent is extended or adjusted under 35 U.S.C. 154(b) by 25 days.

(21) Appl. No.: 11/953,046

(22) Filed: Dec. 8, 2007

(65) Prior Publication Data

US 2008/0135822 A1 Jun. 12, 2008

Related U.S. Application Data

(60) Provisional application No. 60/869,151, filed on Dec. 8, 2006.

(51) Int. Cl.
*E04H 17/16* (2006.01)

(52) U.S. Cl. ..... 256/54; 256/DIG. 3

(58) Field of Classification Search ..... 256/47, 256/48, 50, 54, 56, 57, DIG. 3
See application file for complete search history.

(56) References Cited

U.S. PATENT DOCUMENTS 629,322 A * 7/1899 Canfield ..... 256/56
667,530 A * 2/1901 Johnson ..... 256/56
2,537,719 A * 1/1951 Tuepker ..... 174/45 R
3,411,754 A * 11/1968 Fahrenholz ..... 256/48
4,982,932 A * 1/1991 Baker ..... 256/47

* cited by examiner

*Primary Examiner*—Michael P Ferguson
(74) *Attorney, Agent, or Firm*—Cien G. O'Brien; John L. DeAngelis; Beusse Wolter Sanks Mora & Maire, P.A.

(57) ABSTRACT

A fence clip for holding a fence wire. The fence wire is carried by two spaced-apart lower legs of the fence clip. In an at-rest configuration no external forces are exerted on the fence clip; a spring-like tension force between a body and two spaced-apart upper legs urges the upper legs in contact with a rear surface of a T-post to restrain the fence clip against vertical movement along the T-post. In response to a force directed against the body, the tension force is overcome, permitting vertical movement of the fence dip along the T-post and corresponding vertical movement of the carried fence wire to increase the distance between adjacent fence wires to permit crossing the fence.

8 Claims, 5 Drawing Sheets

ADJUSTABLE FENCE CLIP

The present application claims the benefit under Section 119(e) of the provisional patent application filed on Dec. 8, 2006 and assigned application No. 60/869,151.

FIELD OF THE INVENTION

This invention relates generally to a fence clip for releasably attaching to a fence post and for receiving a fence wire, and specifically to a fence clip that is easily movable vertically along the fence post (with no tools in one embodiment) while secured to the fence post and continuing to support the fence wire.

BACKGROUND OF INVENTION

The prior art discloses a number of different fence wire attachment devices for securing fence wires to a fence post while allowing some limited horizontal motion of the fence wires, i.e., motion of the wire in the plane of the fence or along the fence line. Although fences serve as effective borders between property parcels and restrain livestock within the fenced area, crossing the wire fence when desired is problematic. Whether for work or pleasure, the crossing effort is cumbersome, hazardous and impossible for some people. The crossing effort is exacerbated if one is carrying a tool or firearm. Further, it is significantly more difficult and hazardous to move equipment and harvested animals across the fence line.

To cross the prior art fence the person must climb over the top fence wire (hazardous), climb between two successive fence wires (hazardous, awkward and cumbersome), climb under the lowest fence wire, cut the fence wire (expensive and not cost effective) or pass through the nearest gate (neither timely nor cost effective). Thus the person may decide not to cross the fence at all.

If there is sufficient slack in the fence wire, the application of a downwardly-directed force to the upper fence wire(s) moves it (them) downwardly as the slack is taken up. Thus the wire must be displaceable along its length as the wire is moved vertically. Slack in the wire accommodates such upward or downward displacement of the wire(s). Vertical motion of the wire is prevented or at a minimum constrained if the wire cannot be displaced along its length, such as if the fence wire is rigidly secured to each fence post.

Prior art devices for attaching the fence wire to the post may not allow such displacement of the fence wire along the fence line, may not allow vertical displacement of the fence wire or may not allow both. In either case, these devices prevent vertical movement of the fence wire. Instead, such attachment devices are intended to securely and tightly hold the fence wire in a snug or taut condition to the fence posts. If the wire is fixedly attached to the fence posts on either side of the crossing point, it may be difficult to vertically displace the fence wire as there is little or no slack to be taken up. Advantageously stringing the fence wires in the taut condition allows them to resist external forces exerted on the fence wires, such as snow loads and contact with animals and farm implements. But without slack, the wires are not easily moved vertically. Clearly, fixed attachment of the fence wire to the fence posts impedes vertical movement of the fence wire. Releasing the fence wire from the taut condition to cross the fence is a time-consuming task that may require the use of special tools. The fence wire must then be returned to its taut condition.

The above described difficulties in releasing the fence wires to permit downward or upward displacement of one or more upper fence wires also applies to the upward displacement of the lower fence wires to permit one to crawl under the fence wires.

BRIEF DESCRIPTION OF THE DRAWINGS

The present invention can be more easily understood and the advantages and uses thereof more readily apparent when the following detailed description of the present invention is read in conjunction with the figures wherein.

In accordance with common practice, the various described features are not drawn to scale, but are drawn to emphasize specific features relevant to the invention. Like reference characters denote like elements throughout the figures and text.

DETAILED DESCRIPTION OF THE INVENTION

Figure 1:
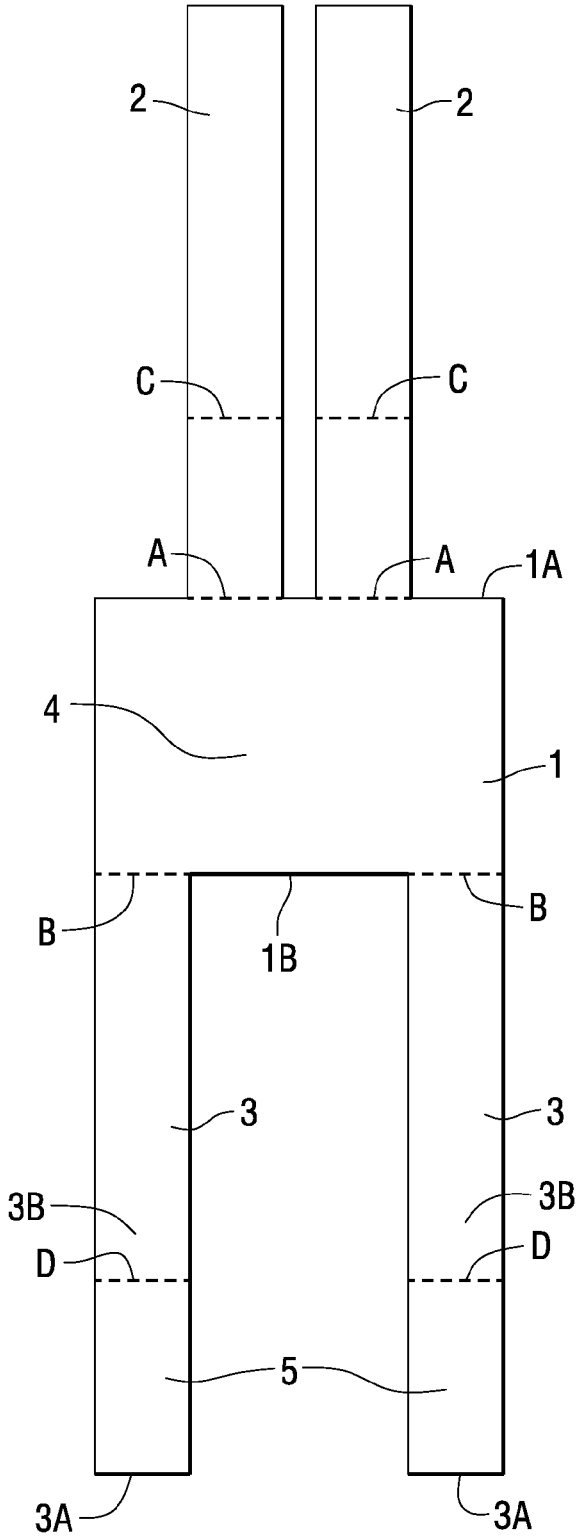
FIG. 1 illustrates a planar material from which a fence clip of the present invention is formed.

Before describing in detail exemplary fence clips, it should be observed that the present invention resides primarily in a novel and non-obvious combination of elements. So as not to obscure the disclosure with details that will be readily apparent to those skilled in the art, certain conventional elements have been presented with lesser detail, while the drawings and the specification describe in greater detail other elements pertinent to understanding the invention.

The following embodiments are not intended to define limits as to the structure of the invention, but only to provide exemplary constructions. The described embodiments are permissive rather than mandatory and illustrative rather than exhaustive.

From the foregoing discussion it can be seen that it is desired to construct a fence clip that secures fence wires to a fence post while conveniently allowing free vertical movement of the fence wire up and down along the fence post. This vertical movement allows two adjacent fence wires to be separated so that a person can cross the fence line. The fence clip must also allow free movement of the fence wire along the fence line (i.e., along a line of the fence wire) to accommodate the wire's vertical movement. As can be appreciated, if the fence wire is extremely taut, vertical movement of the fence wire is not possible or is severely hampered. To create an opening between two adjacent fence wires, there must be some minimal slack in the wire and the wire must be freely moveable vertically (up or down) along the fence post. It has been determined from observation and installation of fence clips according to the present invention that most, if not all, fence wires are strung with sufficient slack to accommodate vertical movement of the fence clip and its supported fence wire according to the present invention.

The fence dip of the present invention allows vertical movement of the fence wires without the use of tools, while retaining a secure fence to keep intruders out and livestock in. The dip eliminates the need to cut the fence wire to cross, ensures that the wires are not stretched to the breaking point and permits a person to easily and timely cross the fence when desired. The fence clip also permits some movement of the wires along the fence line to allow the vertical movement.

Specifically, a fence clip of the present invention supports a fence wire at a desired vertical point on a fence post, while permitting free movement of the wire along the fence line. The clip is secured to a fence post but can be manually displaced by hand to move the clip vertically and thus move the fence wire vertically. To permit movement of the fence wire along the fence line, the fence wire passes freely through one or more rings of the dip such that the wire can move along the fence line relative to the fence clip. Thus the clip and the wire can be moved vertically along a fence post, while slack within the fence wire is taken up to permit the vertical movement.

Vertical movement of the clip can be accomplished without the use of tools to increase the distance between adjacent fence wires (i.e., creating an opening) to allow a person to pass through the opening and thereby cross the fence. In one application each wire forming a fence is supported by a clip of the present invention and each clip is secured to a fence post and moveable vertically relative to the fence post while slack within the wire is taken up.

If vertical movement of one clip and its supported fence wire does not create an opening of sufficient size, it may be necessary to vertically displace a first clip upwardly and a second adjacent clip downwardly to form a larger opening between adjacent fence wires.

The technique for movably supporting the wire in the clip and movably attaching the clip to the post allows the clip and wire to move vertically relative to the post. Further, for the clip/wire combination to move vertically, there must be sufficient slack in the wire (but not an excess amount of slack to the extent that the fence does not accomplish its primary purpose) so that the slack can be taken up as the wire is moved vertically. Movably supporting the wire relative to the clip allows the slack to be taken up for an extended length of wire. The prior art technique of fixedly attaching the wire to each fence post substantially limits the amount of slack in the wire and thus limits the amount of slack available when the wire is vertically displaced to create an opening between two adjacent fence wires.

Thus by permitting vertical movement of the clip relative to the fence and movement of the wire along the fence line, the clip of the present invention allows a person or object to easily cross the fence when desired, including farmers, hunters, cowboys, tools, and materials, while keeping the wire fence securely affixed to the fence posts at all other times.

Additionally, the freedom of fence wire movement along the fence line provided by the clip of the invention allows the fence wire to withstand forces exerted on the wire. In response to these forces the fence wire simply moves along the fence line.

Other advantages of the fence post clip of the invention include:

A) Allowing ranchers, farmers and hunters to cross a fence, at any point, safely and timely B) Allowing tools, equipment, and harvested animals to be moved across a fence at any point in a safe and timely manner.

C) Providing an inexpensive dip that can be attached to any fence post of a new or existing fence without the use of any tools.

D) Providing a clip that allows the fence wire to be manipulated upwardly or downwardly (for crossing) and in-line (for taking up slack) by a person without the application of excessive or damaging forces, thus prolonging the life of the fence.

E) Providing a clip that allows a farmer or rancher to tighten a fence wire along a considerable length of fence without having to free each wire from its attachment to each individual fence post along the length of fence.

F) Providing a clip that provides a mechanism by which a length of fencing can absorb relatively large external forces, such as those created through contact with large animals, farm implements, and snow banks, without placing undue forces on either the wire or the fence posts, since these forces can distort or break the fence wires.

G) Providing a dip that saves farmers, ranchers, and hunters money in clothing, tools, equipment and time, by providing a mechanism that alleviates a problem that generates these expenses.

H) Providing a clip that can be made and sold at a low cost

I) Providing a clip that allows one individual to cross over the fence (safely, easily and timely) no matter the person's age, weight or physical capability, even while carrying a firearm, a tool or equipment.

The various features and embodiments of the invention are hereinafter described and illustrated as a fence clip for securing to a T-shaped post (T-post). The clip is moveable up or down along the T-post, while the wire moves freely relative to the clip. Notwithstanding these desired features, the integrity of the fence is maintained.

Referring now to FIG. 1, in one embodiment the fence clip is made of, but not limited to, spring steel (e.g., a steel blank is formed in the desired shape then hardened/tempered to produce spring-like characteristics). In one embodiment a steel blank 1 is formed in an H-shape as illustrated. The flat H-shaped steel blank 1 comprises two spaced-apart upper legs 2 extending from an edge 1A (the edge 1A forms an upper edge when the fence clip is secured to the T-post) and two spaced-apart lower legs 3 extending from an edge 1B (the edge 1B forms a lower edge when the fence dip is secured to the T-post). The edges 1A and 1B are generally parallel and represent two edges of a fence clip body 4. See FIG. 2. The references to upper legs and lower legs refer the orientation of the legs when the formed clip is secured to the fence T-post.

Figure 2:
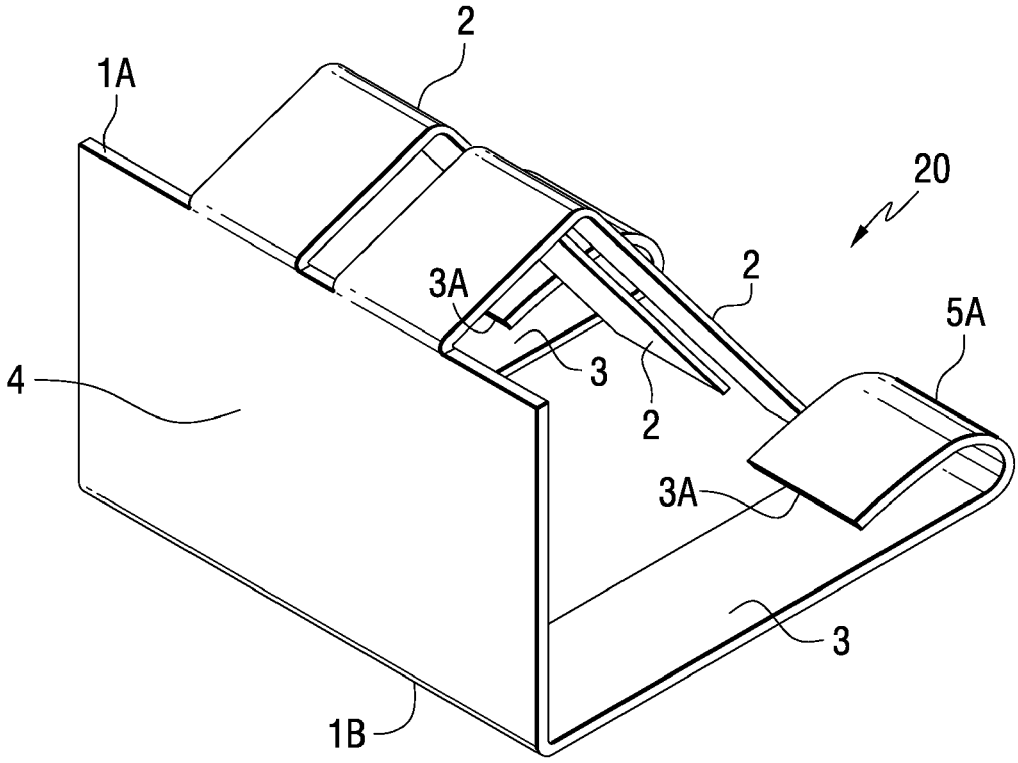
FIG. 2 illustrates the fence clip in the absence of any forces exerted on the dip.

The steel blank 1 is bent along lines A, B, C and D to produce a fence clip 20 illustrated in FIG. 2. Other techniques for forming the clip 20 of the invention can be employed.

FIG. 2 illustrates the fence clip 20 of one embodiment of the present invention in its at-rest configuration (i.e., without any external forces exerted on the fence clip 20). As shown, an end region 5 (see FIG. 1) of each lower leg 3 is formed into a ring 5A. In one embodiment the rings 5A are formed by bending each lower leg 3 along line D of FIG. 1 and bringing edges 3A proximate regions 3B. As can also be seen, in one embodiment the body 4 forms a slight acute angle with a vertical.

Figure 3:
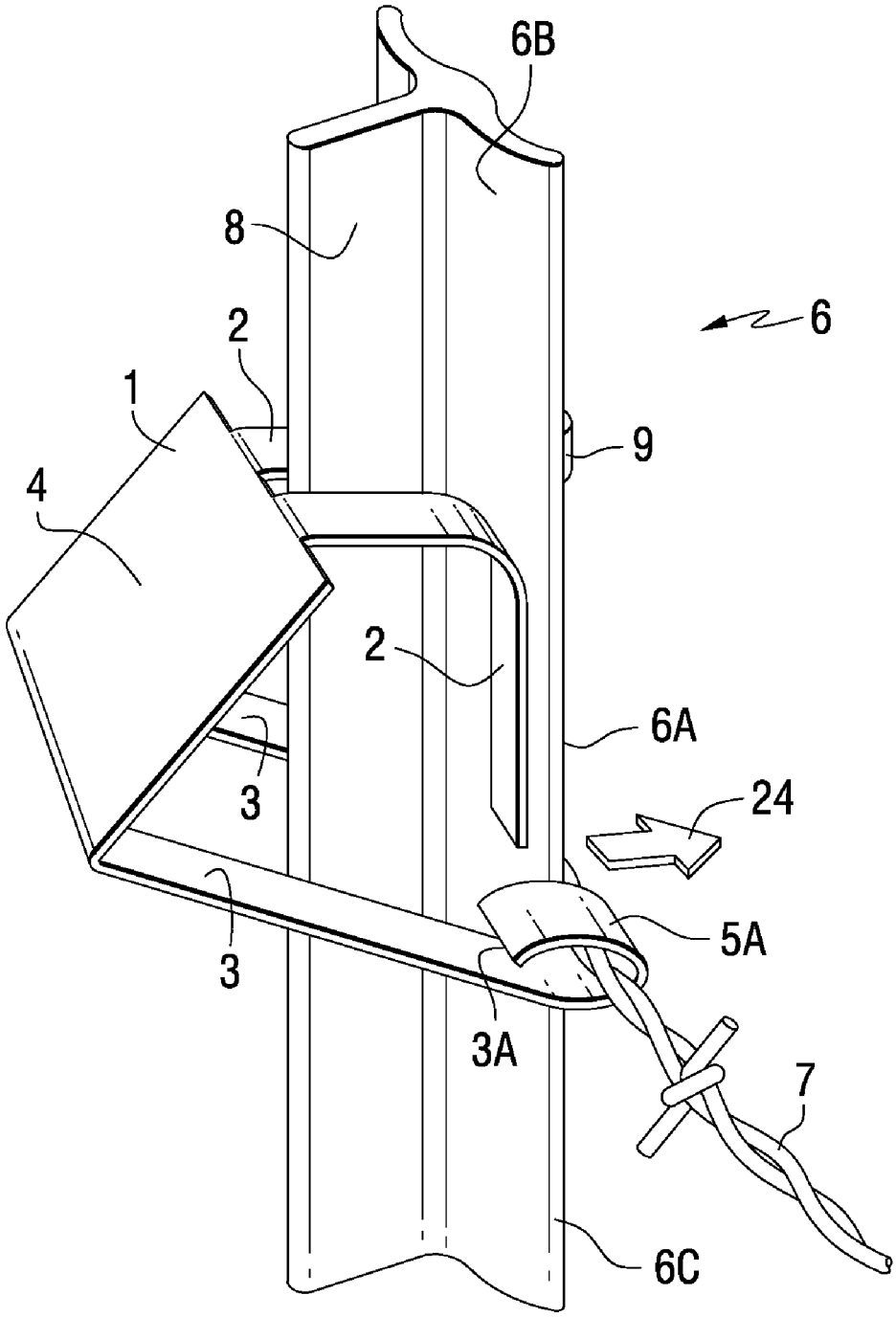
FIG. 3 illustrates the fence clip secured to a fence T-post.
Figure 4:
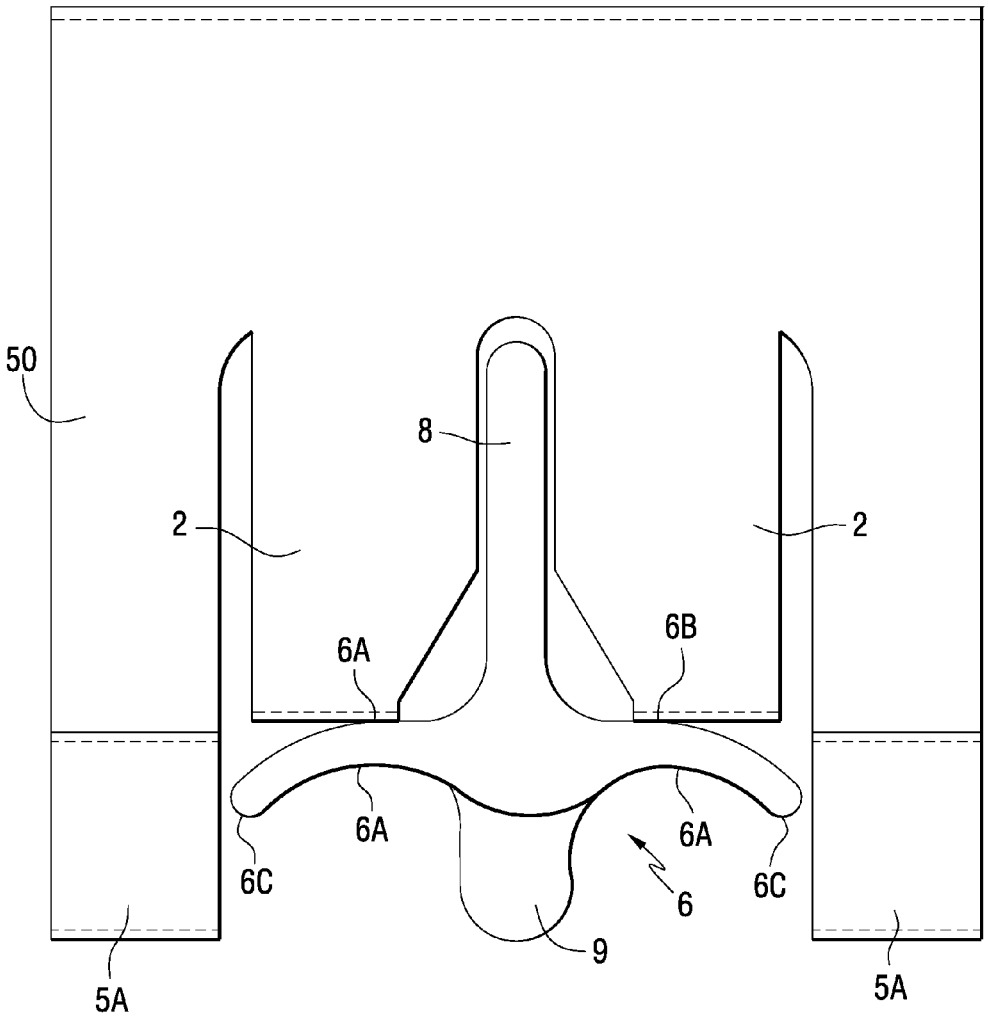
FIG. 4 illustrates a top view of the fence T-post and one embodiment of a fence dip.

When the clip 20 is secured to a fence T-post 6 (see FIGS. 3 and 4), each of the lower legs 3 is proximate a vertical edge 6C of the T-post 6 and the rings 5A extend beyond a front surface 6A of the T-post 6. See FIG. 3 and FIG. 4, the latter depicting a top view of the fence post 6 and another embodiment of a fence clip 50. As illustrated in FIG. 3, a fence wire 7 (a barbed fence wire in the illustrated case) passes through openings formed by each of the rings 5A. FIG. 3 depicts only one ring 5A; the top view of FIG. 4 depicts both rings 5A. The lower legs 3 are outboard of the upper legs 2 as illustrated.

To secure the clip 20 to the T-post 6, the upper legs 2 are positioned on opposing sides of a T-post stem 8. As can be seen from FIGS. 2, 3 and 4, the upper legs 2 straddle the stem 8 and further each upper leg 2 extends vertically downwardly in contact with T-post portions 6B on a rear surface of the T-post 6.

To continue securing the clip 20 to the fence post 6, a user exerts a force against the body 4 to force the lower legs 3 beyond the front surface 6A of the T-post 6. An arrowhead 24 in FIG. 3 illustrates the general direction of the motion of the lower legs 3 responsive to this force. As the lower legs 3 extend beyond the front surface 6A, they move into a proximate relationship with the fence wire 7. If it does not assume the desired position, the wire 7 is manually placed on a top surface of each lower leg 3.

The force manually exerted on the body 4 is removed and the spring tension force exerted between the fixed upper legs 2 and the body 4 causes a lower region of the body 4 and the two rings 5A to move rearward, opposite to the direction of the arrowhead 24 in FIG. 3. During this movement, the rings 5A capture and encircle the wire 7. Further rearward movement of the legs 3/rings 5A continues until the fence wire 7 contacts the T-post front surface 6A, which stops further rearward movement of the legs 3/rings 5A. The tension force develops a holding (frictional) force on the upper legs 2 holding them in contact with the rear regions 6B of the T-post 6. The tension force also tries to move the body opposite to the direction of the arrowhead 24, but this movement is limited by the fence wire resting against the front surface 6A of the T-post 6. Thus the upper legs 2 in contact with the rear regions 6B restrain the fence clip 20 against free vertical movement along the fence post 6.

FIG. 3 illustrates the fence wire 7 and the clip 20 secured to the fence post 6 with the fence wire 7 in contact with the front surface 6A of the T-post 6. The clip 20 is held in this position (preventing vertical movement along the T-post 6) by the tension force exerted between the body 4 and the upper legs 2 as described above. The upper legs 2 are restrained against movement in the direction of the arrowhead 24 by contact with the T-post 6, developing the frictional force.

During installation of the clip 20, the manually-exerted force on the body 4 (in the direction of the arrowhead 24 of FIG. 3) reduces the tension force between the body 4 and the lower legs 3 (reduces the holding or frictional force) and moves the fence wire 7 away from the front surface 6A, thereby permitting vertical movement (either up or down) of the clip 20 along the T-post 6.

As can now be surmised, when it is desired to create an opening in the fence, a force is exerted on the body 4 in a direction of the arrowhead 24 of FIG. 3, moving the wire 7 away from the T-post 6 and from tabs 9 on the front surface of the T-post 6 (see FIGS. 3 and 4). While this force is exerted, the clip 20 and the wire 7 can move freely up or down the T-post 6.

When the force on the body 4 is released, spring action of the clip 20 on the post 6 returns the clip 20 to the FIG. 3 configuration. The wire 7 can be retained in place relative to the T-post 6 in one of the tabs 9. The tension force between the body 4 and the upper legs 2 creates this spring action to return the wire 7 against the front surface 6A of the T-post 6. The fence wire 7 remains in the rings 5A when the clip 20 is moved vertically to create the opening in the fence. Note that to create the vertical movement of the clip 20 and the wire 7, there must be some slack in the wire 7; such slack occurs naturally when the fence wires 7 are strung on the T-posts 6.

The tabs 9 do not necessarily attach the wire 7 to the T-post 6, but merely guide the position of the wire 7 relative to the T-post 6. To provide the wire guiding feature, each tab 9 may define a notch in its top surface.

Exerting the force as explained above, a person can move the fence wires downwardly to walk over the fence wire or upwardly to go under the fence wire. Moving one fence wire up and the next adjacent wire down creates an opening in the fence through which a person can pass. All of these actions, fastening the clip to the post and the wire to the clip and moving the clip, can be accomplished by a single person without the need for tools. This allows a person to cross a fence safely, separating the fence wires and climbing over/under in seconds at any point along the fence line. Neither the fence nor the person's clothes or equipment sustain damage.

Figure 5:
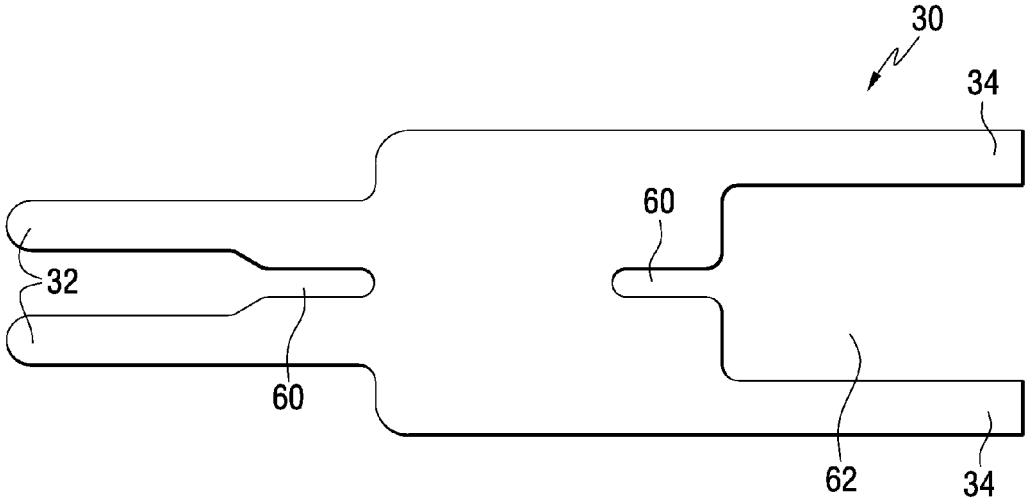
FIG. 5 illustrates a planar material from which a fence clip according to another embodiment of the invention is formed.
Figure 6:
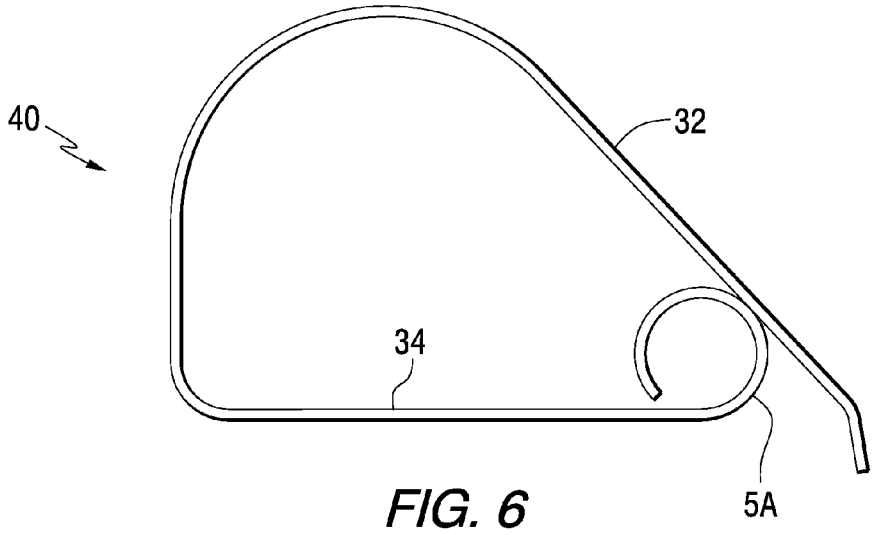
FIG. 6 illustrates a side view of a fence clip according to one embodiment of the invention.

FIG. 5 illustrates an alternative H-shaped steel blank 30 having two spaced-apart upper legs 32 and two spaced-apart lower legs 34. A dip 40 formed from the blank 30 is illustrated in FIG. 6. The dip 40 functions like the clips 20 and 50 described above and is secured to the T-post in a similar manner. When formed into the dip 40, the T-post stem 8 fits within the openings 60 of the blank 30. The width of the T-post 6 fits within the opening 62 between the lower legs 34.

Although the invention has been shown and described with respect to certain preferred embodiments, it is obvious that equivalent alterations and modifications will occur to others skilled in the art upon reading and understanding this specification and the annexed drawings. In particular regard to the various functions and attributes performed by the above described elements, these are intended to correspond to any element that performs the specified function of the described element (i.e., that is functionally equivalent), even though not structurally equivalent to the disclosed structure. In addition, while a particular feature of the invention may have been disclosed with respect to only one of several embodiments, such feature may be combined with one or more other features of the other embodiments as may be desired and advantageous for any given or particular application.

What is claimed is:

1. A fence clip assembly for supporting a fence wire, comprising a fence clip supported by a fence T-post having a vertically extending stem and a pair of opposing arms longitudinally extending along and protruding from a front edge of the stem and defining a front surface and a rear surface, the fence clip comprising:

a planar body having a lower edge and an upper edge;

a pair of spaced-apart upper legs extending from the upper edge in a first direction, a portion at a distal end of each of the upper legs extending downwardly toward the lower edge;

a pair of spaced-apart lower legs extending from the lower edge in the first direction and disposed outboard of the upper legs, each lower leg terminated in a ring for receiving the fence wire;

the fence clip being secured to the T-post from the rear surface of the T-post and the first direction in a direction toward the T-post such that the upper legs straddle the stem and the lower legs straddle the stem and the arms;

wherein in a first configuration the fence clip body is disposed proximate the rear surface and inclined upwardly between the upper and the lower edges with the upper edge closer to the rear surface than the lower edge, the upper legs are in contact with the rear surface of the arms of the T-post and a tension force between the upper legs and the body restrains the fence clip against free vertical movement along the T-post and urges the fence wire against the front surface of the T-post; and wherein responsive to a manual forward-directed force against the body, when the fence clip is in a second configuration, a lower region of the body is moved closer to the rear surface of the T-post and the rings are moved away from the front surface of the T-post in the first direction when compared to the first configuration, in the second configuration the forward-directed force overcomes the tension force to permit manual vertical movement of the fence clip on the T-post, after the fence clip is moved vertically to move the fence wire, the applied force is removed and the fence clip returns to the first configuration.

2. The fence clip assembly of claim 1 wherein in the first configuration no external forces are directed against the fence clip.

3. The fence clip assembly of claim 1 wherein in the first and the second configurations each of the lower legs is proximate a vertical edge of each arm of the T-post.

4. The fence clip assembly of claim 1 wherein the T-post further comprises tabs on a front surface of the T-post, the tabs for engaging the fence wire and further supporting the fence wire.

5. The fence clip assembly of claim 1 wherein the upper edge and the lower edge are substantially parallel.

6. The fence clip assembly of claim 1 wherein the tension force is due to a spring tension force between the body and the upper legs.

7. The fence clip assembly of claim 1 wherein each ring is formed by bending a first end region of each lower leg onto a spaced-apart second region of each lower leg.

8. The fence clip assembly of claim 1 wherein a material of the fence clip comprises a spring steel material.

* * * * *